US011421832B2

(12) United States Patent
Galli et al.

(10) Patent No.: US 11,421,832 B2
(45) **Date of Patent: *Aug. 23, 2022**

(54) FLASHLIGHT WITH MULTIPLE LIGHT SOURCES

(71) Applicant: Emissive Energy Corp., North Kingstown, RI (US)

(72) Inventors: Robert D. Galli, North Kingstown, RI (US); Christopher J. O'Brien, North Kingstown, RI (US); Mikhail T. Hyde, North Kingstown, RI (US)

(73) Assignee: Emissive Energy Corp., North Kingstown, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/325,441

(22) Filed: May 20, 2021

(65) Prior Publication Data

US 2021/0278052 A1 Sep. 9, 2021

Related U.S. Application Data

(63) Continuation of application No. 17/000,417, filed on Aug. 24, 2020, now Pat. No. 11,015,770.

(60) Provisional application No. 62/891,696, filed on Aug. 26, 2019.

(51) Int. Cl.

| | |
|---|---|
| ***F21L 4/02*** | (2006.01) |
| ***F21L 4/04*** | (2006.01) |
| ***F21Y 115/10*** | (2016.01) |

(52) U.S. Cl.

CPC ..... *F21L 4/027* (2013.01); *F21L 4/045* (2013.01); *F21Y 2115/10* (2016.08)

(58) Field of Classification Search

CPC ..... F21L 4/027; F21L 4/045
USPC ..... 362/202
See application file for complete search history.

(56) References Cited

U.S. PATENT DOCUMENTS

| | | | | |
|---|---|---|---|---|
| 2,330,673 | A * | 9/1943 | Braum | F21L 2/00 362/184 |
| 5,871,272 | A * | 2/1999 | Sharrah | F21V 31/03 362/184 |
| 5,876,110 | A * | 3/1999 | Uke | F21V 31/00 362/184 |
| 5,971,562 | A * | 10/1999 | Yang | F21L 4/045 362/184 |
| 6,260,985 | B1 * | 7/2001 | Zeller | F21L 2/00 362/157 |
| 7,896,518 | B2 | 3/2011 | Holmes et al. | |
| 7,961,381 | B2 * | 6/2011 | Pochapsky | G02B 23/12 359/353 |
| 8,147,089 | B2 * | 4/2012 | Matthews | F41G 1/36 362/199 |
| 9,016,887 | B2 | 4/2015 | Weinrich | |
| 9,995,468 | B2 * | 6/2018 | Liang | F21V 5/04 |
| 2004/0095755 | A1 | 5/2004 | Hsien | |

(Continued)

FOREIGN PATENT DOCUMENTS

CN 106545771 A 3/2017

*Primary Examiner* — Bryon T Gyllstrom
(74) *Attorney, Agent, or Firm* — Barlow, Josephs & Holmes, Ltd.; Stephen J. Holmes

(57) ABSTRACT

The present disclosure generally relates to lights and flashlights, and more specifically to a handheld flashlight which has at least two LED light sources and the ability to change between the light sources by twisting the head portion of the flashlight.

17 Claims, 6 Drawing Sheets

(56) References Cited

U.S. PATENT DOCUMENTS

| | | | | |
|---|---|---|---|---|
| 2006/0077657 | A1* | 4/2006 | Vickers | F21V 23/0414<br>362/205 |
| 2010/0046211 | A1* | 2/2010 | Spartano | F21L 4/045<br>362/157 |
| 2012/0275142 | A1* | 11/2012 | Lundy | F21L 4/027<br>362/184 |
| 2014/0268703 | A1* | 9/2014 | Ehlert | F21V 23/04<br>362/184 |
| 2018/0038577 | A1 | 2/2018 | Jones | |

* cited by examiner

FLASHLIGHT WITH MULTIPLE LIGHT SOURCES

CROSS-REFERENCE TO RELATED APPLICATIONS

This application is a continuation of U.S. application Ser. No. 17/000,417, filed Aug. 24, 2020, which is a non-provisional filing of, and claims the benefit of, U.S. Provisional Patent Application No. 62/891,696, filed Aug. 26, 2019, the entire contents of which are incorporated herein by reference.

BACKGROUND OF THE DISCLOSURE

Embodiments of the invention generally relate to lights and flashlights, and more specifically to a flashlight having multiple light sources and the ability to quickly change light sources by rotating the flashlight head.

Typical flashlight designs include a single source of illumination. However, for many activities of the military, law enforcement and others, multiple different types of light may be needed or desired for different purposes. For example, a user may require a white light source for general use and an infrared light source for night vision equipment. Additionally, multiple different color temperatures of visible light may be desirable in outdoor night uses for illuminating different types of terrain. These different needs thus require personnel to carry and use multiple different flashlights.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
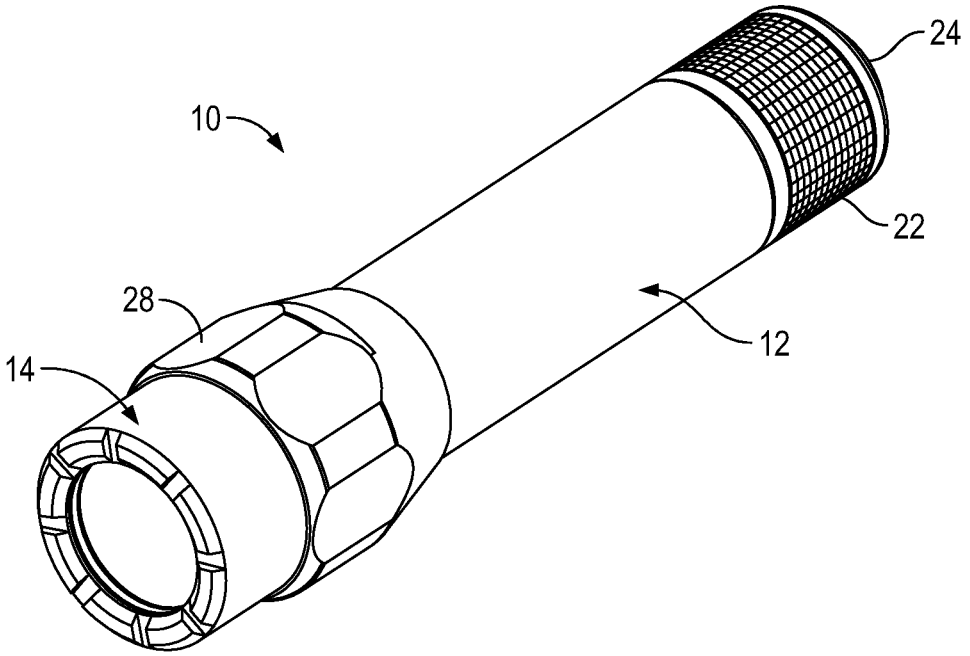
FIG. 1 is a perspective view of a flashlight in accordance with the present invention.
Figure 2:
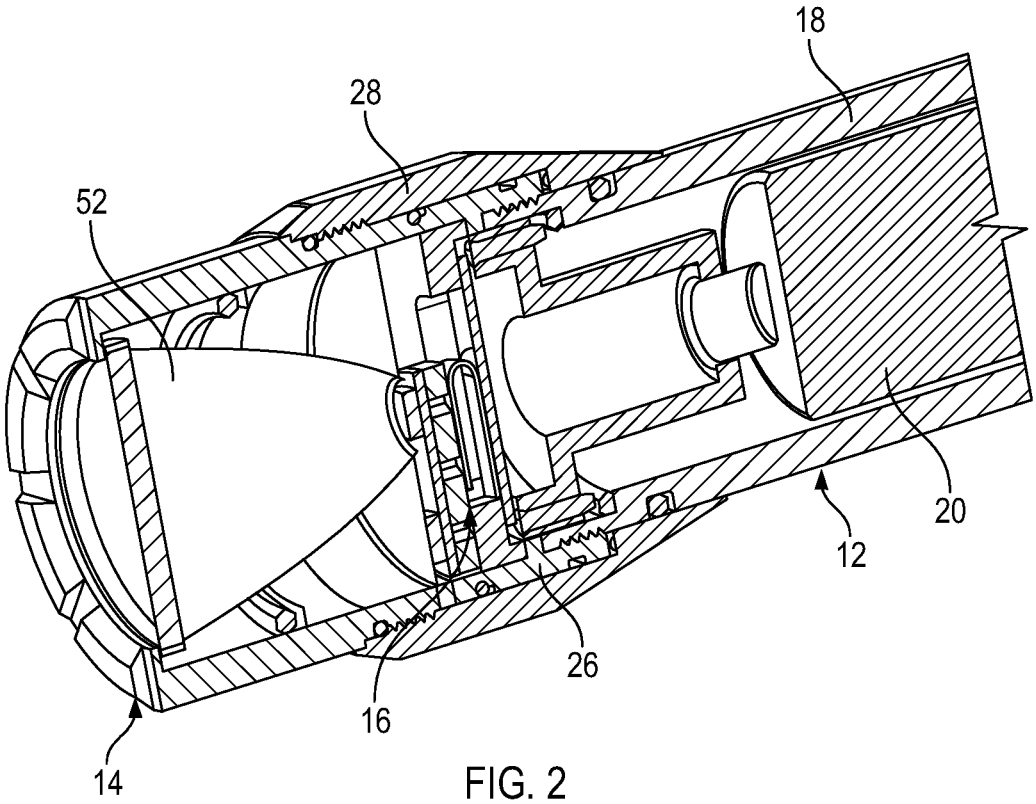
FIG. 2 is a cross-sectional view thereof taken along line 2-2 of FIG. 1.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

The present disclosure generally relates to lights and flashlights, and more specifically to a handheld flashlight which has at least two LED light sources and the ability to change between the light sources by twisting the head portion of the flashlight.

Referring to FIGS. 1-10, an exemplary embodiment is illustrated. Generally, the flashlight assembly 10 utilizes a sliding yoke mechanism to translate rotational movement of a head assembly into linear motion of an internal yoke on which two light emitting diodes (LED's) are mounted. Rotation between two positions respectively aligns the LED's with a reflector cup within the head assembly for operative use.

The flashlight assembly 10 generally comprises a housing assembly 12, a head assembly 14, and a yoke assembly 16 captured between the housing assembly 12 and the head assembly 14.

The housing assembly 12 has an elongated body 18 with a head end and a tail end. A power source 20, such as a battery, is received within the body 18 and the tail end includes a removable cap 22, which may include a switching mechanism 24 for operation of the light. The switching mechanism 24 may comprise a mechanical switch or other type of electronic switch providing multiple functions.

Figure 3:
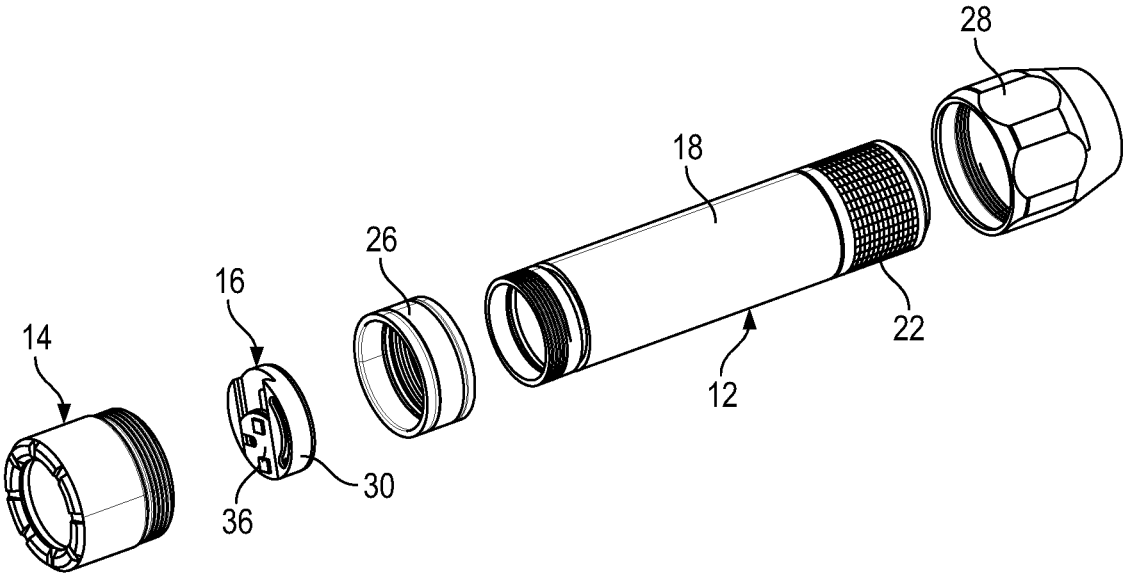
FIG. 3 is an exploded perspective view of the flashlight.
Figure 4:
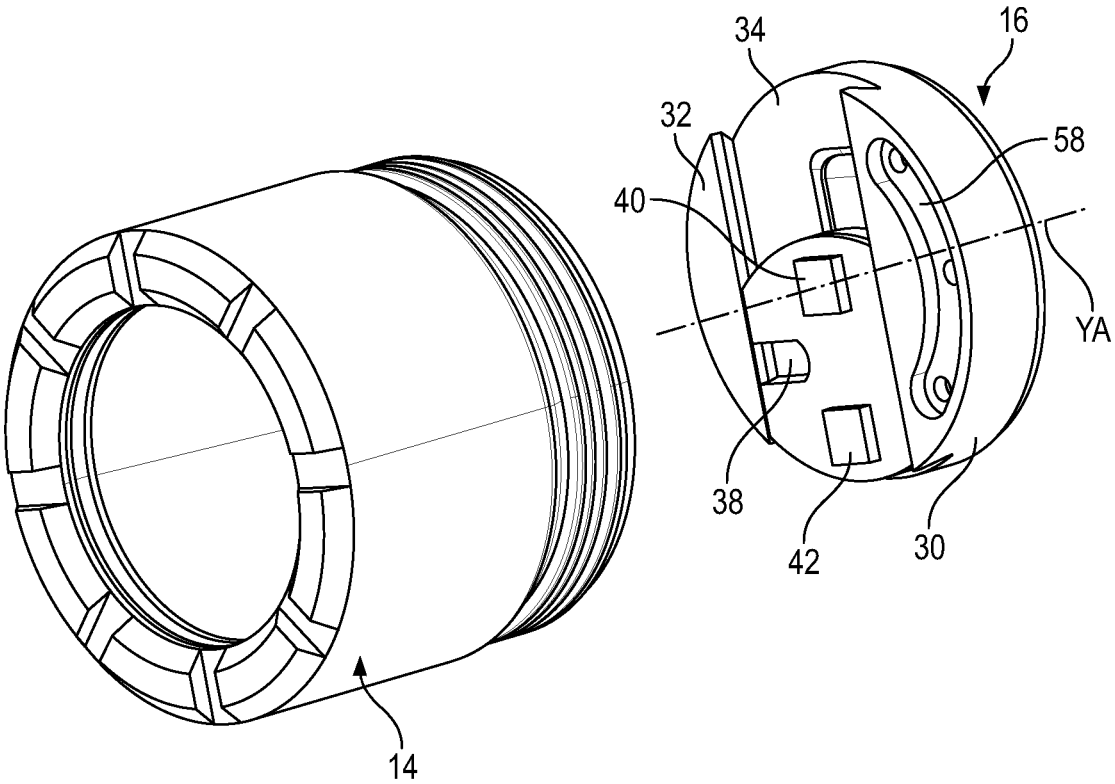
FIG. 4 is an enlarged exploded view of the head assembly and yoke assembly.
Figure 5:
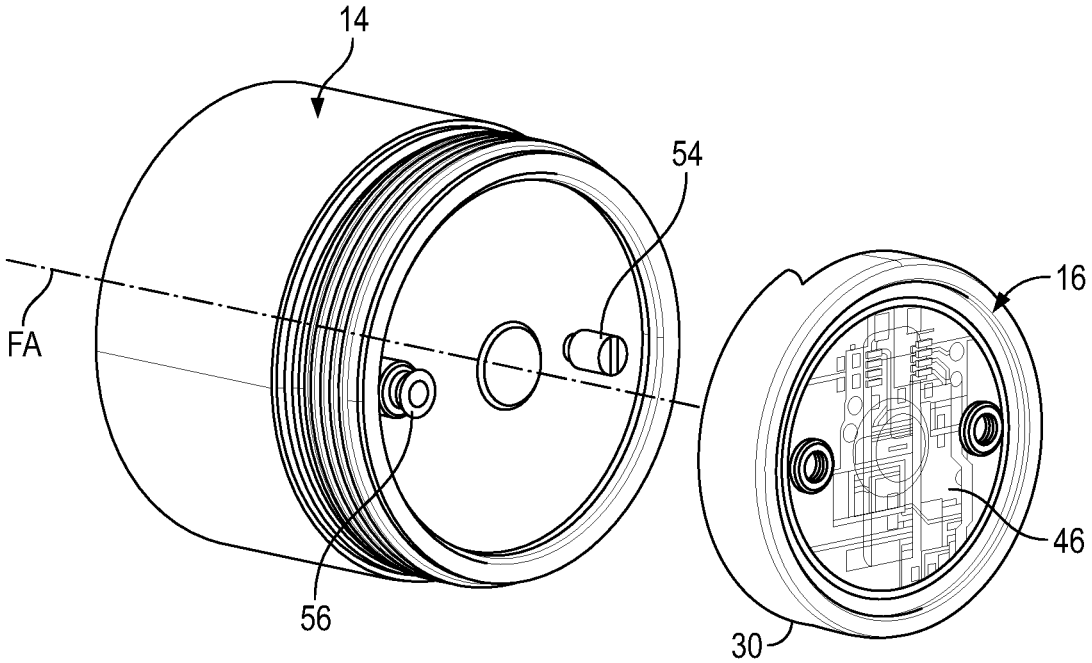
FIG. 5 is another exploded view of the head assembly and yoke assembly from the rear.
Figure 6:
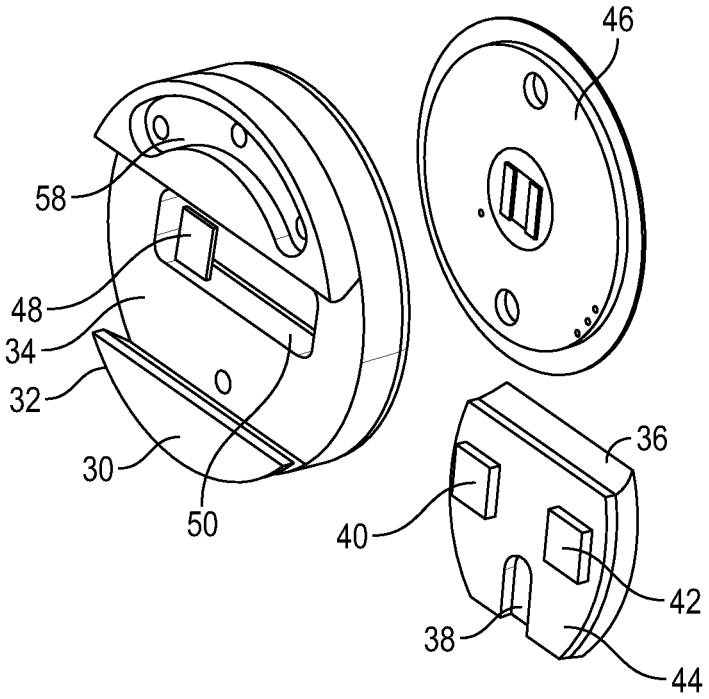
FIGS. 6 and 7 are exploded front and rear views of the yoke assembly.
Figure 7:
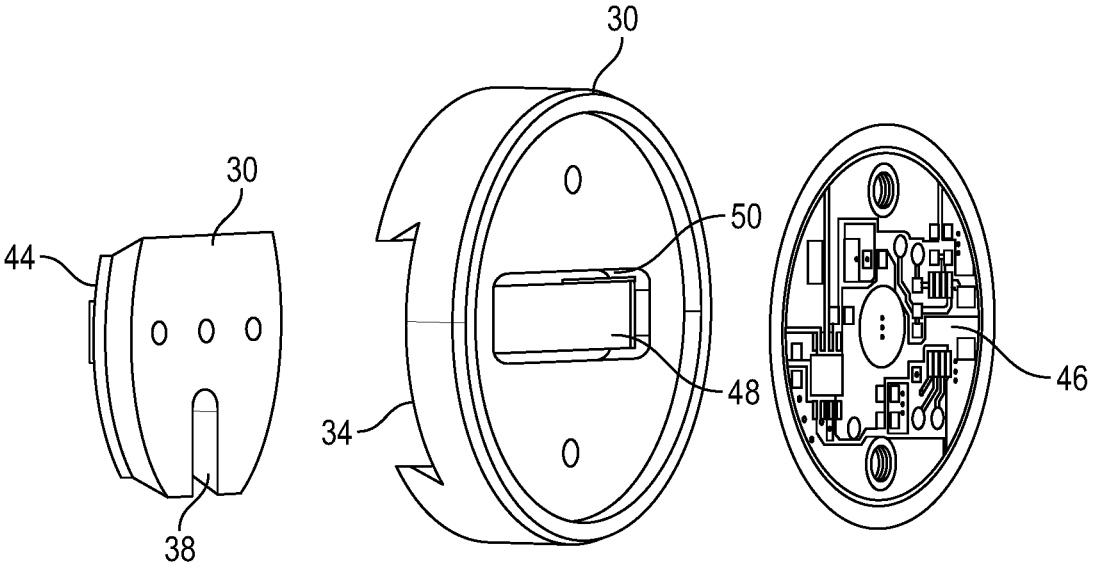

Referring to FIGS. 2-5, the yoke assembly 16 is seated (press fit) into the top side of a receiver ring 26 which in turn is threaded onto the head end of the body 18. The head assembly 14 is received on top of the yoke assembly 16 and receiver ring 26 and is in turn held in assembled relation with the yoke assembly 16 and body 18 with an external rotating grip ring 28. Referring to FIG. 3, the grip ring 28 is slid up around the body 18 from the tail end and threaded onto the bottom end of the head assembly 14. The arrangement of parts allows for the rotation of the grip ring 28 and head assembly 14 relative to the housing assembly 12 and yoke assembly 16 for twisting operation. Various contact pins, springs and o-rings are located between the various parts to maintain electrical contacts and waterproof seals (See FIG. 2).

Now referring to FIGS. 4-8, the yoke assembly 16 includes a disc-shaped body 30 having a central axis (YA), an upper surface 32 and a transverse guide slot 34 extending across the upper surface 32. The guide slot 34 encompasses a transverse line (TL) (FIG. 8) extending through the central axis (YA). In the exemplary embodiment having a cylindrical shape, the transverse line (TL) is a diametric line extending across the disc-shaped yoke body 30. The yoke assembly 16 further includes a yoke plate 36 which is slidably captured in the transverse guide slot 34, and the yoke plate 36 includes a drive slot 38 offset from the central axis (YA) and extending perpendicular to the transverse line (TL). The guide slot 34 and yoke plate 36 may in some embodiments have complementary dovetail shapes or similar sliding slot shapes.

The exemplary embodiment as illustrated includes a first LED 40 and a second LED 42 which may operate at different wavelengths. The wavelength and/or type of light is irrelevant for purposes of the invention. The key points are that there are at least two light sources provided and that the user can select between the two light sources. The LED's 40, 42 are mounted in spaced relation on a carrier circuit board 44 which is mounted on top of the yoke plate 36 and further they are mounted such that their focal axes are aligned on the transverse line (TL). In this regard, as the yoke plate 36 slides within the guide slot 34, the LED's 40, 42 move linearly along the transverse line (TL). The yoke assembly 16 further includes an LED control circuit on a circuit board 46 which is received in a recess on the bottom surface of the yoke body 30. The LED's 40, 42 are electronically coupled to the circuit board 46 by a flex circuit 48 extending through an elongated slot 50 in the yoke body 30. The flex circuit 48 permits the sliding movement of the yoke plate 36 while maintaining the electrical connection. Alternatively, the LED's may in some embodiments be connected by spring loaded wiping contacts or other similar contacts.

The head assembly 14 includes a parabolic reflector cup 52 having a focal axis (FA) which is coaxially aligned with the yoke body 30 central axis (YA) when the head assembly 14 is received in assembled relation with the body 18 and yoke body 30. Additionally, the head assembly 14 includes a drive pin 54 extending from the rear surface thereof, offset from the focal axis (FA) and received within the drive slot 38 of the yoke plate 36 when assembled. Still further, the head assembly 14 includes a spring-loaded detent pin 56 also offset from the focal axis (FA) and extending from the rear surface thereof. The detent pin 56 is received in an arcuate guide slot 58 in the yoke body 30 and the slot 58 includes detent positions A, B, C which correspond to rotational positions of the grip ring 28 and head assembly 14 (See FIGS. 9A, 9B, 9C).

Figure 8:
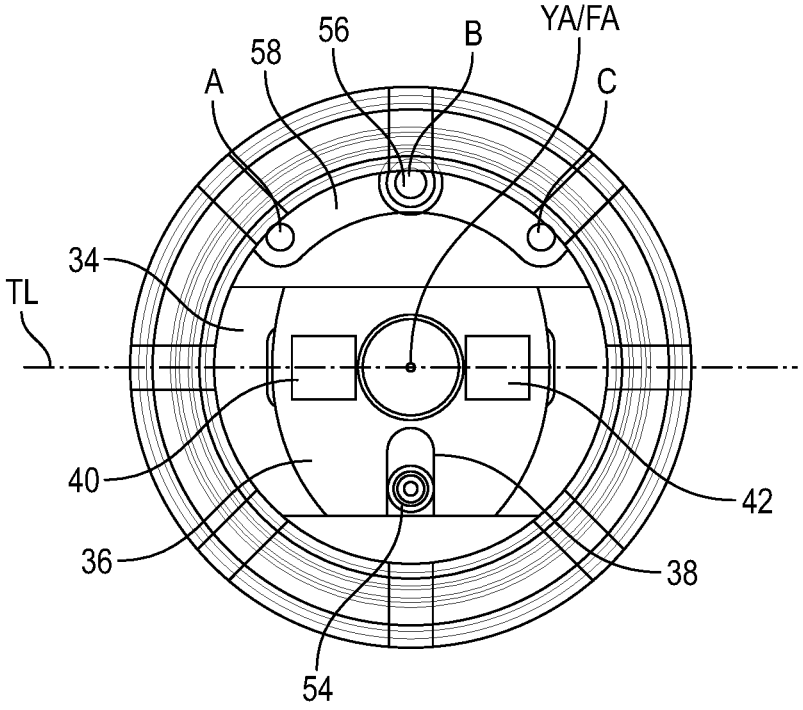
FIG. 8 is an end view of the head assembly and the yoke assembly with the head assembly in transparent view and showing the alignment of the drive pin and drive slot on the yoke plate and alignment of the detent pin with the detent plate.
Figure 9A:
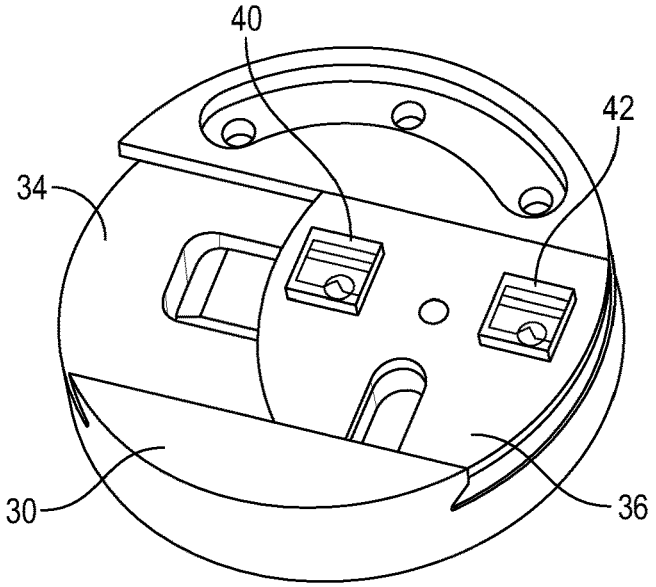
FIGS. 9A-9C are sequential views showing movement of the yoke plate and mounted LED's between 3 defined positions.
Figure 9B:
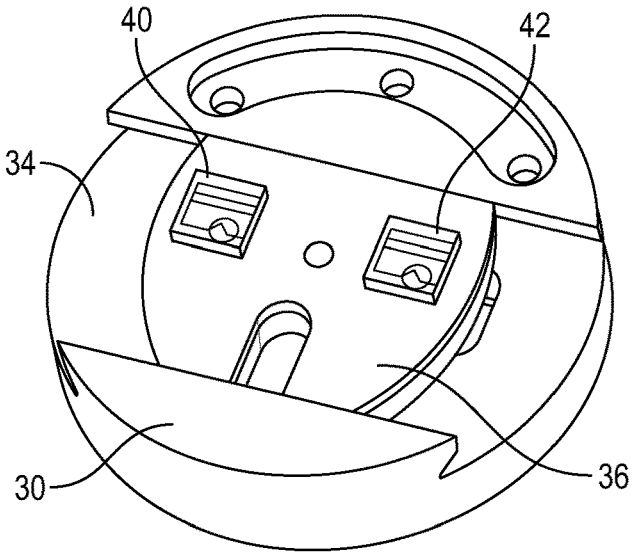
Figure 9C:
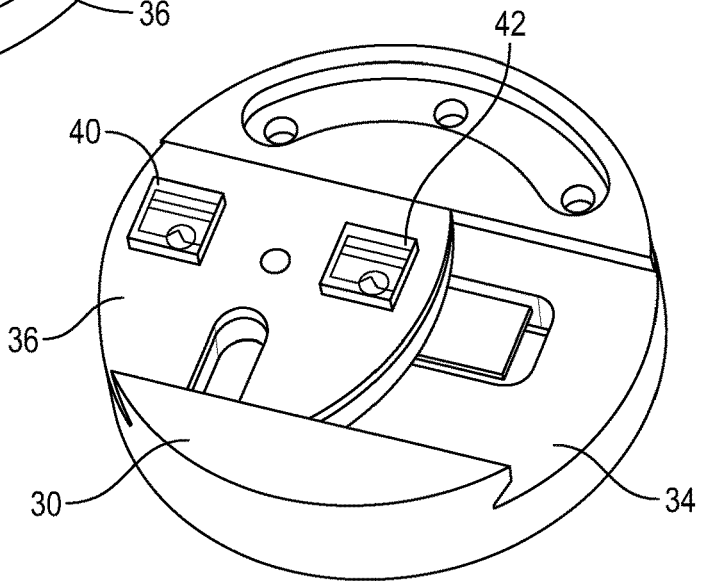

Referring now to FIGS. 8 and 9A-9C, the yoke plate 36 is slidably movable between at least a first position (FIG. 9A) wherein the first LED 40 is aligned with the focal axis (FA) and yoke axis (YA), and a second position (FIG. 9C) wherein the second LED 42 is aligned with the focal axis (FA) and yoke axis (YA). FIGS. 8 and 9B illustrates an intermediate position where no LED is aligned and may represent an "off" or inactive position. Other exemplary embodiments may include additional LED's and the yoke plate 36 may be slidably movable and set to align such additional LED's on the focal axis.

Figure 10A:
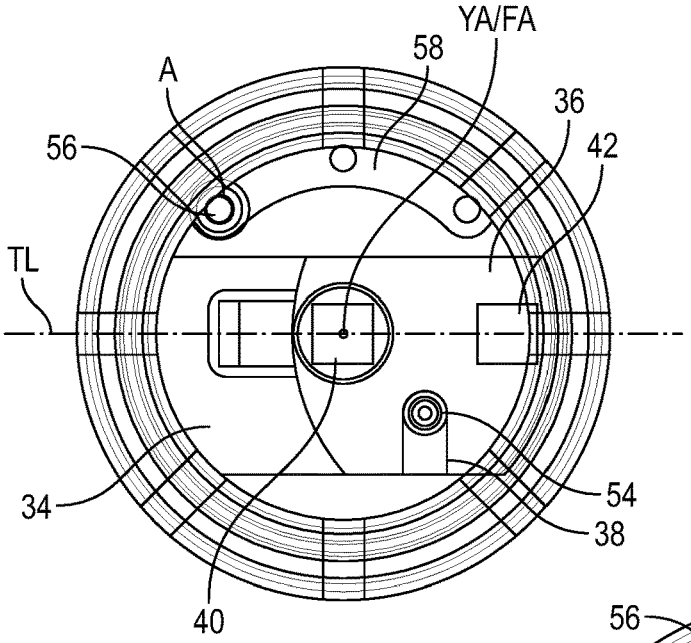
FIGS. 10A-10C are similar sequential views showing rotation of the head assembly and corresponding sliding movement of the yoke plate between the 3 defined positions.
Figure 10B:
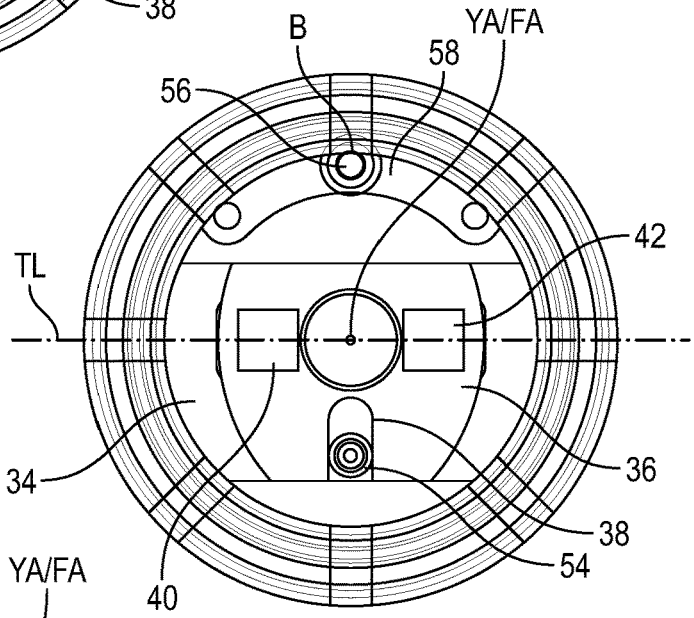
Figure 10C:
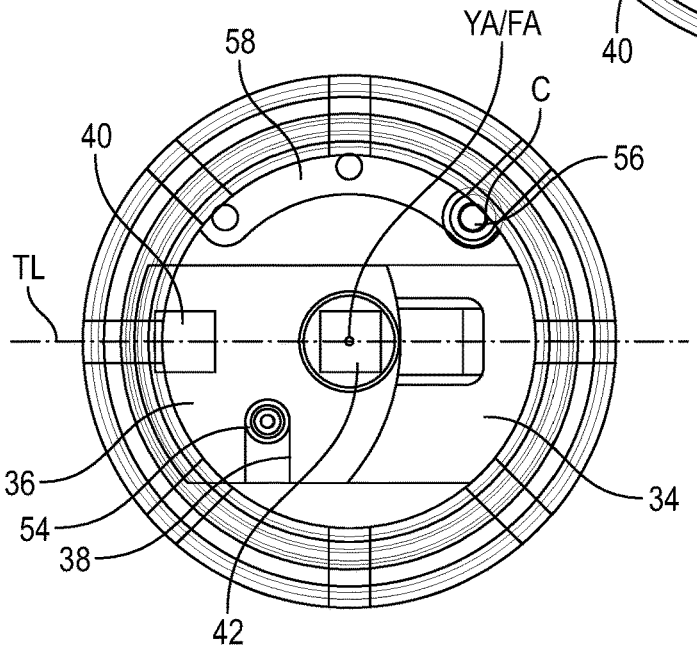

As described hereabove, the flashlight assembly 10 is functional to convert a rotational movement of the head assembly 14 to a corresponding linear translation of the yoke plate 36. Referring to FIGS. 10A-10C, engagement of the drive pin 54 and drive slot 38 and detent pin 56 and detent slot 58 are illustrated showing the corresponding movements. The head assembly 14 is shown in a transparent state to illustrate the alignments. The drive pin 54 rides within the drive slot 38 with rotation of the drive pin 54 (head assembly) causing corresponding linear translation of the yoke plate 36. The detent pin 56 and detent slot 58 limit the rotational movement of the head assembly 14, while the detent position indents A, B, C create a tactile indication of set positions. FIG. 10A corresponds to FIG. 9A with the first LED 40 in alignment with the focal axis (FA). The head assembly 14 is rotated to the left detent position A. FIG. 10B corresponds to FIG. 9B with the head assembly 14 rotated to the center detent position B (no LED aligned). FIG. 10C corresponds to FIG. 9C with the head assembly 14 rotated to the right detent position C and the second LED 42 aligned with the focal axis (FA). As noted above, rotation of the head assembly 14 and drive pin 54 drives linear movement of the yoke plate 36.

While the exemplary embodiment depicts a cylindrical handheld flashlight, the present yoke mechanism can be implemented in any type of illumination device, in any shape and in any configuration as needed for the end user.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A flashlight assembly comprising:

a housing;

a yoke assembly comprising, a yoke body affixed to the housing, said yoke body having a central axis, and a transverse guide slot, a yoke plate slidably captured in the transverse guide slot, said yoke plate further including a drive slot, and a first LED and a second LED both mounted to said yoke plate in spaced relation and aligned with the transverse guide slot; and a head assembly rotatably assembled with the housing and having a focal axis coaxially aligned with said yoke central axis, said head assembly including a drive pin extending from a rearward end thereof, said drive pin engaging said drive slot in said yoke plate wherein rotation of said head assembly relative to said yoke assembly causes a corresponding sliding movement of said yoke plate.

2. The flashlight assembly of claim 1 wherein said guide slot encompasses a transverse line extending across said yoke body and through said central axis.

3. The flashlight assembly of claim 2 wherein said drive slot is offset from said central axis and extends perpendicular to said transverse line.

4. The flashlight assembly of claim 3 wherein said first LED and said second LED are aligned on said transverse line.

5. The flashlight assembly of claim 2 wherein said first LED and said second LED are aligned on said transverse line.

6. The flashlight assembly of claim 5 wherein said head assembly includes a reflector cup, said reflector cup defining said focal axis.

7. The flashlight assembly of claim 2 wherein said head assembly includes a reflector cup, said reflector cup defining said focal axis.

8. The flashlight assembly of claim 1 wherein said head assembly includes a reflector cup, said reflector cup defining said focal axis.

9. The flashlight assembly of claim 8 wherein said first and second LED's are mounted on a carrier circuit board mounted on an upper surface of said yoke plate, said flashlight further including a control circuit board mounted on said yoke body, and a flex circuit connecting said carrier circuit board with said control circuit board.

10. The flashlight of claim 9 wherein said flex circuit extends through a slot in said yoke plate.

11. The flashlight assembly of claim 1 further comprising a receiver ring secured to an upper end of said housing, said yoke body affixed to said receiver ring.

12. The flashlight assembly of claim 11, further comprising a grip ring secured about said head assembly and rotatably received about the upper end of said housing and said receiver ring.

13. The flashlight assembly of claim 1 wherein said yoke body further comprises an arcuate detent slot, and said head assembly including a detent pin which rides within said detent slot, said detent slot having detents therein to define said first and second positions.

14. The flashlight assembly of claim 13 wherein said first and second LED's are mounted on a carrier circuit board mounted on an upper surface of said yoke plate, said flashlight further including a control circuit board mounted on said yoke body, and a flex circuit connecting said carrier circuit board with said control circuit board.

15. The flashlight of claim 14 wherein said flex circuit extends through a slot in said yoke plate.

16. The flashlight assembly of claim 1 wherein said first and second LED's are mounted on a carrier circuit board mounted on an upper surface of said yoke plate, said flashlight further including a control circuit board mounted on said yoke body, and a flex circuit connecting said carrier circuit board with said control circuit board.

17. The flashlight of claim 16 wherein said flex circuit extends through a slot in said yoke plate.

* * * * *